United States Patent [19]

Ahmed

[11] 4,260,945

[45] Apr. 7, 1981

[54] REGULATED CURRENT SOURCE CIRCUITS

[75] Inventor: Adel A. A. Ahmed, Clinton Township, Hunterdon County, N.J.

[73] Assignee: RCA Corporation, New York, N.Y.

[21] Appl. No.: 27,735

[22] Filed: Apr. 6, 1979

[51] Int. Cl.[3] ..... G05F 1/56

[52] U.S. Cl. ..... 323/316; 307/297; 330/288

[58] Field of Search ..... 323/1, 4, 9, 22 T; 307/296 R, 297; 330/288, 290, 296

[56] References Cited

U.S. PATENT DOCUMENTS

| | | | |
|---|---|---|---|
| 3,629,692 | 12/1971 | Goyer | 323/4 |
| 3,754,181 | 8/1973 | Kreitz et al. | 323/1 |
| 3,925,718 | 12/1975 | Wittlinger | 323/4 |
| 3,952,257 | 4/1976 | Schade, Jr. | 323/4 X |
| 4,032,839 | 6/1977 | Ahmed | 323/9 X |

OTHER PUBLICATIONS

R. J. Widlar, "Low Voltage Techniques", IEEE Journal of Solid-State Circuits, vol. SC-13, No. 6, Dec. 1978, pp. 838-846.

*Primary Examiner*—William M. Shoop
*Assistant Examiner*—Peter S. Wong
*Attorney, Agent, or Firm*—Paul J. Rasmussen; Peter M. Emanuel; Allan J. Jacobson

[57] ABSTRACT

Regulated current sources of a type comprising first and second transistors of complementary conductivity types having respective input and output electrodes, the output electrode of each direct coupled to the input electrode of the other to complete a regenerative feedback loop tending to increase conduction in both transistors. The increased conduction of the second transistor is sensed by the input circuit of an amplifier exhibiting increasing gain for increased signal sensed by its input circuit. The output circuit of this amplifier is connected to the input electrode of the second transistor to complete a degenerative feedback loop which counteracts the regenerative feedback loop at prescribed current levels to establish the level of current regulation.

19 Claims, 10 Drawing Figures

Figure 1:
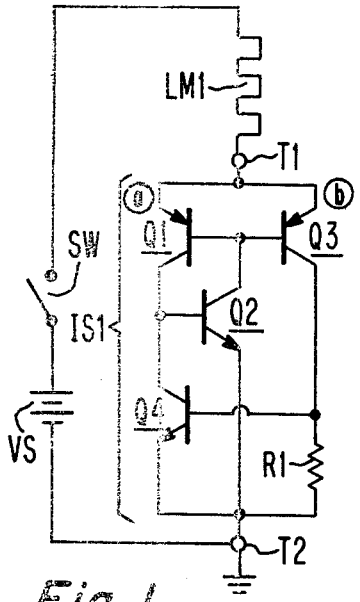

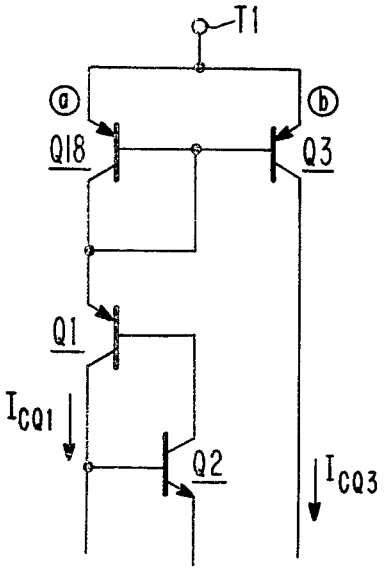
Fig. 7.
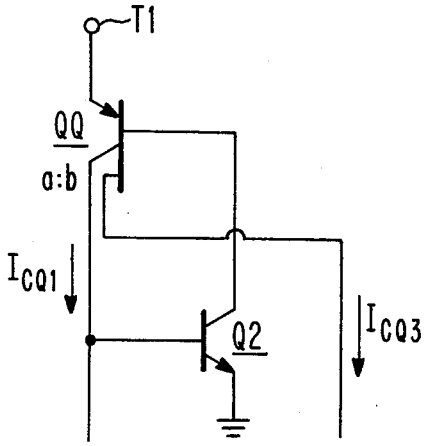
Fig. 8.
Fig. 9.
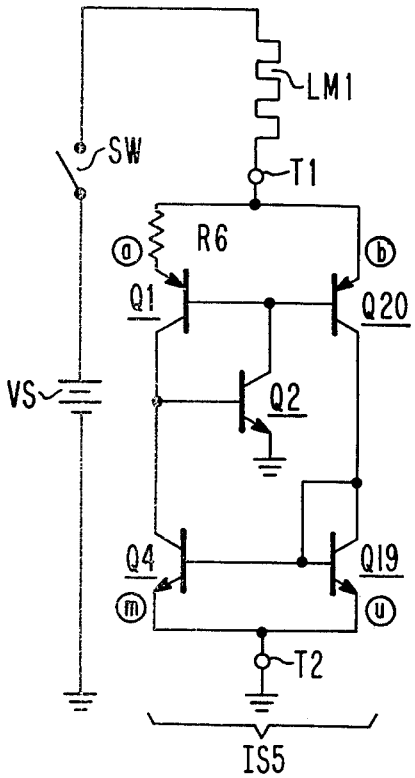
Fig. 10.
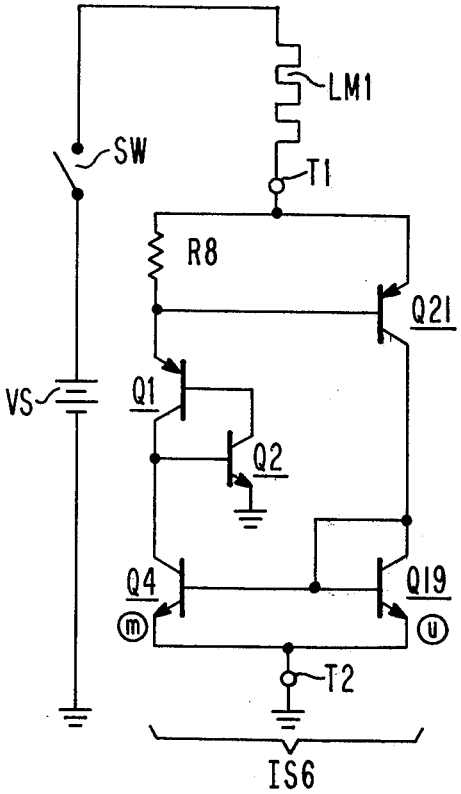

REGULATED CURRENT SOURCE CIRCUITS

The present invention relates to regulated current sources of a type suitable for integrated construction.

Known types of monolithic regulated current sources employ a pair of current amplifiers in regenerative loop connection, the output circuit of each current amplifier being connected to the input circuit of the other, which regenerative loop exhibits decreasing current gain with increased levels of current. These types of regulator tend to exhibit problems insofar as initiation of conduction in the regenerative loop is concerned.

The connection of first and second transistors of complementary conductivity types in a regenerative loop by connecting the output electrode of each to the input electrode of the other and applying an operating potential between their respective common electrodes is a connection well-known to be so unstable as invariably to result in the transistors being spontaneously latched into conduction upon application of operating potential.

The present invention is embodied in regulated current source circuitry in which this regenerative loop connection of first and second transistors is permitted to increase the conduction of the first and second transistors up to a level determined by a counteracting degenerative loop in which the output electrode of the second transistor is direct-coupled to its input electrode via a non-linear amplifier means, the gain of which increases with increasing level of conduction through the second transistor. The regulated current source includes means for supplying an output current proportional to the current flowing through the first transistor.

In the drawing each of the FIGS. 1–10, except 7 and 8, is a regulated current source circuit embodying the present invention and each of FIGS. 7 and 8 shows a modification that can be made to the current regulators of FIGS. 1, 3, 4 and 5.

In FIG. 1, whenever switch SW is closed, the current flow from voltage source VS through load means LM1 and from terminal T1 to terminal T2 of a two-terminal current regulator IS1 is regulated to a value substantially equal to $(a+b)V_{BEQ4}/bR_1$. $V_{BEQ4}$ is the emitter-to-base offset potential of transistor Q4 and is substantially constant over a range of currents; $R_1$ is the resistance of resistive element R1 connected between the emitter and base electrodes of Q4; and the collector currents of transistors Q1 and Q3 are in a:b ratio for similar respective emitter-to-base potentials $V_{BEQ1}$ and $V_{BEQ3}$. The ratio of the collector currents of a pair of transistors constructed in monolithic form with similar junction profiles is conventionally controlled by scaling of their respective collector areas in the case of lateral-structure PNP transistors and by scaling of the respective areas of their emitter-base junctions in the case of vertical-structure NPN transistors.

Of particular interest in the direct coupling of the collector electrodes of first and second transistors Q1 and Q2 to the base electrodes of each other to form a high-gain regenerative loop, which is self-starting whenever sufficient current flows to T1 to raise the potential thereat sufficiently to exceed the potential required to forward-bias the emitter-base junctions of Q1 and Q2. This regenerative feedback loop tends to increase the currents flowing through Q1 and Q2. Q2 is provided with direct coupled collector-to-base feedback, not only by the common emitter amplifier action of Q1 completing a regenerative feedback loop connection with Q2, but also by a non-linear amplifier completing a degenerative feedback loop connection with Q2. This non-linear amplifier exhibits increasing gain as the levels of current in Q1 and Q2 increase, to divert increasingly the collector current of Q1 to its output circuit rather than being applied as base current to Q2. This leads to stabilization of the levels of current in Q1 and Q2 at levels where the open-loop gains of the regenerative and degenerative loops including Q2 become equal.

In FIG. 1 the non-linear amplifier which is connected in degenerative feedback loop with Q2 comprises transistors Q3, Q4 and resistive element R1. The current flowing through the principal current conduction path of Q2, its emitter-to-collector path, is applied to the parallelled emitter-base junctions of Q1 and Q3 to cause respective collector currents $I_{CQ1}$ and $I_{CQ3}$ in a:b ratio to each other. This, owing to the differences in the base input impedances of Q1 and Q3, their respective common-emitter forward current gains $h_{feQ1}$ and $h_{feQ3}$ being ideally expected to be the same in the conventional monolithic integrated circuit construction. $I_{CQ3}$ flows primarily through R1 causing a potential drop thereacross substantially equal to $I_{CQ3}R1$. At lower levels of $I_{CQ3}$ this potential drop will not be large enough to bias transistor Q4 into conduction or at least into substantial conduction. Accordingly, at most Q4 exhibits low common-emitter forward current gain $h_{feQ4}$ such that the current gain in the degenerative feedback connection formed by the cascaded common-emitter amplifier actions of Q3 and Q4, which even neglecting the shunting effect of R1 cannot exceed $[b/(a+b)]$ times $h_{feQ3}$ times $h_{feQ4}$, will be less than the current gain in the regenerative feedback connection provided by Q1, which equals $[a/(a+b)]$ times $h_{feQ1}$.

However, as $I_{CQ3}$ increases in response to increasing the conduction in Q2, so the $I_{CQ3}R_1$ drop reaches the 600 millivolts or so that Q4 requires (if it be a silicon transistor) to be biased into substantial conduction, $h_{feQ4}$ will increase. Then, even allowing for that portion of $I_{CQ3}$ diverted to R1 rather than flowing as base current to Q4, $[b/(a+b)]$ times the cascaded common-emitter amplifier gains of Q3 and Q4 will exceed $[a/(a+b)]$ times $h_{feQ1}$. Therefore the open-loop gain of the degenerative feedback loop will equal that of the regenerative feedback loop at current levels associated with a 600 mV or so $I_{CQ3}R_1$ potential drop. Thus the value of $I_{CQ3}$ is determined by the choice of $R_1$ and, in accordance with Ohm's Law, is substantially equal to that 600 mV or so drop divided by R1. Since $I_{CQ1}$ is a/b times $I_{CQ3}$ and the total current flow between T1 and T2 is substantially equal to $I_{CQ1}$ and $I_{CQ3}$ (the combined respective base currents $I_{BQ1}$ and $I_{BQ3}$ of Q1 and Q3 flowing through the collector-to-emitter path of Q2 being smaller than the combined $I_{CQ1}$ and $I_{CQ3}$ by the common-emitter forward current gain of PNP transistors Q1 and Q3), the total current flow between T1 and T2 is substantially equal to $(a+b)V_{BEQ4}/bR_1$.

The two-terminal current regulator provided between terminals T1 and T2 can be serially connected with the load means LMI in reverse order from that shown in FIG. 1 to supply positive current to the load means, rather than demanding positive current from it. As another alternative, the two terminals T1 and T2 may have the voltage supply VS connected directly across them without intervening load means, and a regulated current may be provided at the output circuit of an auxiliary amplifier having its input circuit connected between suitable points in the basic two-terminal current regulator for scaling its output current to current in the current regulator.

Figure 2:
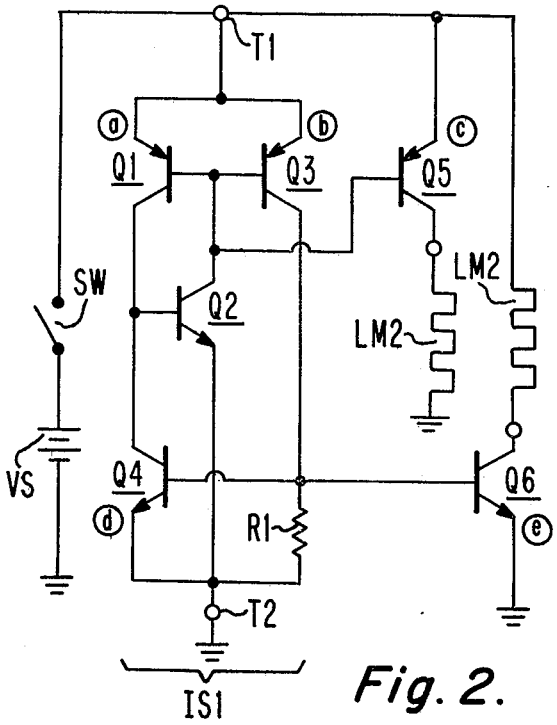

FIG. 2 shows two ways in which this may be done. Transistor Q5 has its emitter-base junction connected in parallel with those of transistors Q1 and Q2 for conditioning Q5 to supply a collector current substantially equal to $cV_{BEQ4}/bR_1$ to load means LM2, with Q1 and Q3 and Q5 being so proportioned as to have collector currents in a:b:c ratio for equal emitter-to-base voltages. Transistor Q6 has its emitter-base junction connected in parallel with that of Q4 for conditioning Q6 to demand a collector current substantially equal to $aeV_{BEQ4}/bdR_1$, with Q1 and Q3 still being so proportioned as to have collector currents in a:b ratio for equal emitter-to-base voltages, and with Q4 and Q6 being so proportioned as to have collector currents in d:c ratio for equal emitter-to-base voltages.

Figure 3:
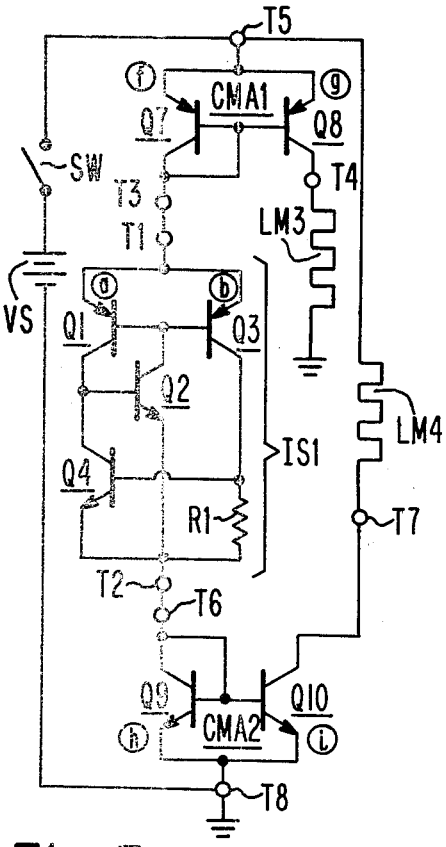

FIG. 3 shows the basic two-terminal current regulator IS1 arranged to be serially connected with the input circuits of current mirror amplifiers CMA1 and CMA2 across the voltage supply VS, conditioning the respective output circuits of CMA1 and CMA2 to supply respective currents to load means LM3 and to load means LM4. CMA1 has input, output and common terminals T3, T4 and T5, respectively. CMA1 exhibits a current gain of −(g/f) owing to the relative physical proportions of its component transistors Q7 and Q8, so LM3 receives a current (g/f) times as large as the current demanded at T1 of current regulator IS1. CMA2 has input, output, and common terminals T6, T7 and T8, respectively. CMA2 exhibits a current gain of −(j/h) owing to the relative physical proportions of its component transistors Q9 and Q10, so LM4 has a current drawn through it (j/h) times as large as the current supplied at terminal T2 of current regulator IS1.

Figure 4:
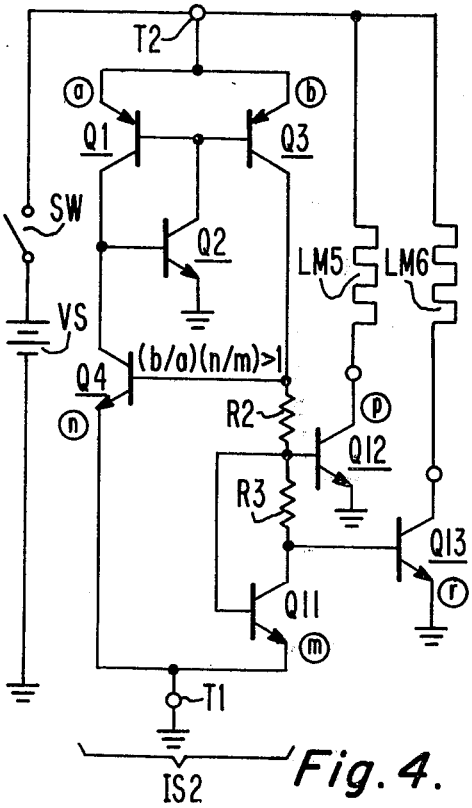

FIG. 4 shows a two-terminal current regulator IS2 differing from IS1 in that R1 is replaced by the series connection of a resistive element R2 (with a resistance of $R_2$) and a self-biased transistor Q11. The drop across R2 decrements the emitter-to-base voltage of Q4 for application as the emitter-to-base voltage of NPN transistor Q12 to condition Q12 to demand a collector current flow through load means LM5. Q11 may, as shown, be self-biased with an enfolded collector resistor R3 (with a resistance of $R_3$) between its collector and base electrodes through which its collector current is drawn, for decrementing its emitter-to-base voltage before application as the emitter-to-base junction of another transistor Q13 to condition it to demand a collector current flow through load means LM6. When Q13 is not used to couple IS2 to a load means LM6, R3 may be replaced by direct connection between the collector and base electrodes of Q11. The collector currents of Q11 and Q4 would be in m:n ratio were their respective emitter-to-base voltages $V_{BEQ11}$ and $V_{BEQ4}$ equal.

When switch SW is first closed and current levels in IS2 are low, there will be no appreciable $I_{CQ3}R_2$ potential drop across R2, so Q11, and Q4 will behave like a current mirror amplifier having a current gain −(n/m). The open-loop current gain of the degenerative feedback connection comprising Q3, Q11, Q4, R2 will have a value substantially equal to $-(n/m)h_{feQ3}$, where $h_{feQ3}$ is the common-emitter forward current gain of Q3. To ensure starting $-(n/m)h_{feQ3}$ must be substantially smaller than the common-emitter forward current gain $h_{feQ1}$ of Q1. In a monolithic integrated circuit construction $h_{feQ1}$ and $h_{feQ3}$ will be substantially equal, so this means m should exceed n preferably by a few times to assure starting of conduction in the regenerative feedback loop connection of Q1 and Q2.

As current levels rise in IS2, stemming from the regenerative connection of Q1 and Q2, the potential drop $I_{CQ3}R_2$ appearing across $R_2$ owing to the collector current $I_{CQ3}$ of Q3 will increase, allowing Q4 to conduct a collector current $I_{CQ4}$ in increasingly greater than n/m ratio to $I_{CQ3}$. The current levels in IS2 will no longer increase when the collector current $I_{CQ4}$ of Q4 approaches $I_{CQ1}$ in amplitude. In this stabilized condition $I_{CQ4}$ is in a:b ratio with the collector current $I_{CQ11}$ of Q11. This leads to a difference between the respective emitter to base voltages $V_{BEQ4}$ and $V_{BEQ11}$ of Q4 and Q11 by an amount that is calculable proceeding from the following well-known approximation descriptive of transistor action:

$$V_{BE}=(kT/q)\ \ln\ (I_C/AJ_S) \tag{1}$$

wherein $V_{BE}$ is the emitter-to-base potential of the transistor;
$I_C$ is its collector current;
A is the effective area of its emitter-base junction;
$J_S$ is the density of current flow through a junction in the transistor when $I_C=0$;
k is Boltzmann's constant;
q is the charge on an electron; and
T is the absolute temperature at which the transistor is operated.

For transistors located proximately on the same monolithic die and formed by the same processing steps $J_S$ and T are substantially equal. Equation 1 will be particularized for Q4 and Q11 by subscripting $V_{BE}$, $I_C$ and A with their respective reference numerals thereby to obtain equations 2 and 3 following.

$$V_{BEQ4}=(kT/Q)\ \ln\ (I_{CQ4}/A_{Q4}J_S) \tag{2}$$

$$V_{BEQ11}=(kT/Q)\ \ln\ (I_{CQ11}/A_{Q11}J_S) \tag{3}$$

The difference between $V_{BEQ4}$ and $V_{BEQ11}$, appearing as the potential drop $V_{R2}$ across resistor R2, is obtained by subtraction of equations 2 and 3.

$$V_{R2}=(kT/g)\ \ln\ (I_{CQ4}A_{Q11}/I_{CQ11}/A_{Q4}) \tag{4}$$

As noted above, $A_{Q11}$ and $A_{Q4}$ are in m:n ratio; under stabilized conditions $I_{CQ4}$ and $I_{CQ11}$ are in a:b ratio. Under these conditions $V_{R2}$ assumes its largest value $V_{R2\text{-}MAX}$ as expressed in equation 5.

$$V_{R2\text{-}MAX}=(kT/q)\ \ln\ (am/bn) \tag{5}$$

By Ohm's Law one can determine the maximum current $I_{R2\text{-}MAX}$, flowing through R2 having a resistance $R_2$ under stabilized conditions, as follows.

$$I_{R2\text{-}MAX}=V_{R2\text{-}MAX}/R_2=(kT/qR_2)\ \ln\ (am/bn) \tag{6}$$

This current also flows, neglecting base currents, as $I_{CQ3}$ and $-I_{CQ11}$. At the same time a current a/b times as large, again neglecting base currents flows as $I_{CQ1}$ and $-I_{CQ4}$. So the total current flowing between terminals T1 and T2 will have a value substantially equal to $[1+(a/b)]\ (kT/q\ R_2)\ \ln\ (am/bn)$.

Q12, by reason of its emitter-base junction parallelling that of Q11 and the effective area of its emitter-base junction being in p:m ratio with that of Q11, will demand a collector current $I_{CQ12}$ of (p/m) (kT/q $R_2$) ln (am/bn).

The collector current $I_{CQ13}$ demanded by Q13 can be determined by particularizing equation 1 for transistor Q13 by subscripting $V_{BE}$, $I_C$ and A with its reference numeral to obtain equation 7 following.

$$V_{BEQ13}=(kT/q)\ \ln\ (I_{CQ13}/A_{Q13}J_S) \quad (7)$$

The difference betwen $V_{BEQ11}$ and $V_{BEQ13}$ appears as the potential drop $V_{R3}$ across resistor R3; $V_{R3}$ can be found by subtracting equation 7 from equation 3, resulting in the following equation 8.

$$V_{R2}=(kT/q)\ \ln\ (I_{CQ11}A_{Q13}/I_{CQ13}A_{Q11}) \quad (8)$$

As indicated in FIG. 4 $Q_{Q11}$ and $A_{Q13}$ are in m:r ratio, permitting equation 8 to be rewritten as follows.

$$V_{R3}=(kT/q)\ \ln\ (rI_{CQ11}/mI_{CQ13}) \quad (9)$$

Currents substantially equal to $I_{CQ11}$ flow through both resistors R2 and R3, so the following relationship obtains in accordance with Ohm's Law, wherein $V_{R3\text{-}MAX}$ is the value of $V_{R3}$ under stabilized conditions and $R_3$ is the resistance of R3.

$$V_{R3\text{-}MAX}/R_3=V_{R2\text{-}MAX}/R_2 \quad (10)$$

Substituting equations 5 and 9 into equation 10 allows us to obtain the following result for the stabilized operating conditions.

$$I_{CQ11}/I_{CQ13}=(m/r)\ (am/bn)^{(R3/R2)} \quad (11)$$

Since $I_{CQ11}$ equals $I_{R2\text{-}MAX}$ under these conditions, substitution of equation 6 into equation 11 provides the value for $I_{CQ13}$ under such conditions.

$$I_{CQ13}=[(kT/qR_2)\ \ln\ (am/bn)]/(m/r)\ (am/bn)^{(R3/R2)} \quad (12)$$

By proper proportioning of R2 and R3, $I_{CQ13}$ can be made relatively very, very small.

Figure 5:
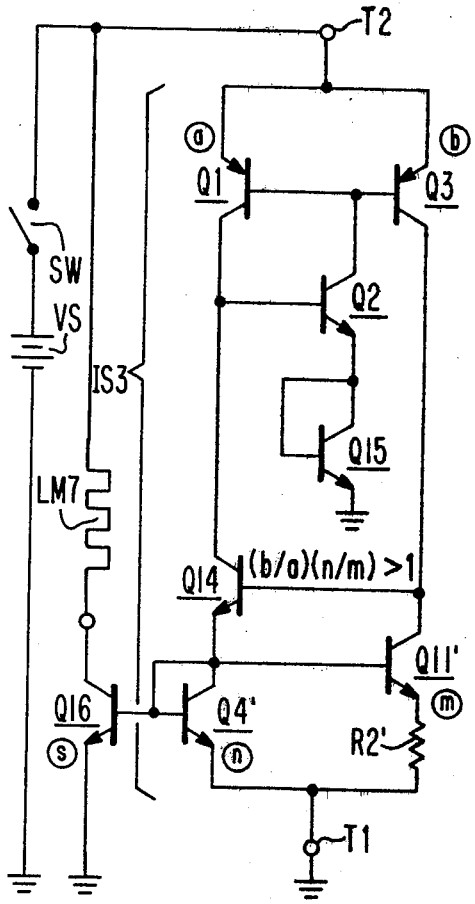

FIG. 5 shows a two-terminal current regulator IS3 differing from regulator IS2 with regard to the non-linear amplifier employed in the degenerative feedback loop. This non-linear amplifier comprises in addition to Q3 a further common-emitter amplifier transistor Q14, but of NPN conductivity type, provided with non-linear degenerative emitter-to-base current feedback through the agency of NPN transistors Q4' and Q11' and resistor R2'. Self-biased transistor Q15 offsets the potential at the emitter electrode of Q2 from that at terminal T1 sufficiently that Q14 has normal operating potential available to it. (A PNP emitter-follower transistor with base at T1 and emitter connected to the emitter of Q2 is used instead in circuits where load means is inserted between terminal T1 and the negative pole of operating voltage supply VS.)

At low current levels, where the potential drop across R2' is negligible, Q4' and Q11' operate as a current mirror amplifier with current gain m/n, reducing the base-to-collector gain of Q14 by degenerative feedback to substantially n/m. The resultant low gain of the degenerative collector-to-base feedback connection of Q2 permits the increase of current levels in the regenerative feedback loop connection of Q2 with Q1.

The potential drop $V_{R2'}$ across R2' increases with increased current levels in Q1 and Q2 and thus in Q3, Q14, Q4' and Q11'. This reduces the emitter-to-base potential $V_{BEQ11'}$ vis-a-vis the emitter-to-base potential $V_{BEQ4'}$ of Q4' and thus reduces the current gain of the non-linear degenerative emitter-to-base feedback connection of Q14. Under stabilized operating conditions, the effective base-to-collector current gain of Q14 will be a/b, requiring $V_{R2'}$ to assume a maximum level defined by equation 13.

$$V_{R2'\text{-}MAX}=(kT/q)\ ln\ (am/bn) \quad (13)$$

The current flowing substantially as $I_{CQ3}$ and $-I_{CQ11'}$ where $I_{CQ11}$ is the collector current of Q11' and through R2' will be Ohm's Law have a value substantially equal to (kT/q $R_{2'}$) ln (am/bn) under stabilized operating conditions, where $R_{2'}$ is the resistance of resistor R2'. The current flowing substantially as $I_{CQ1'}$ $-I_{CQ14}$ and $-I_{CQ4'}$ (where $I_{CQ14}$ and $I_{CQ4'}$ are the respective collector currents of Q14 and Q4') will have a value substantially equal to (a/b) (kT/q $R_{2'}$) ln (am/bn) under stabilized operating conditions. The total current flow between terminals T2 and T1 under stabilized operating conditions will be [1+(a/b)] (kT/q $R_{2'}$) ln (am/bn). The current mirror amplifier relationship between NPN transistors Q4' and Q16, shown as having effective emitter-to-base junction areas in n:s ratio, will cause Q16 to draw a collector current $I_{CQ16}$ equal to (s/n) (a/b) (kT/q $R_{2'}$) ln (am/bn) through load means LM7, in instances where Q16 and LM7 are used in conjunction with current regulator IS3.

Figure 6:
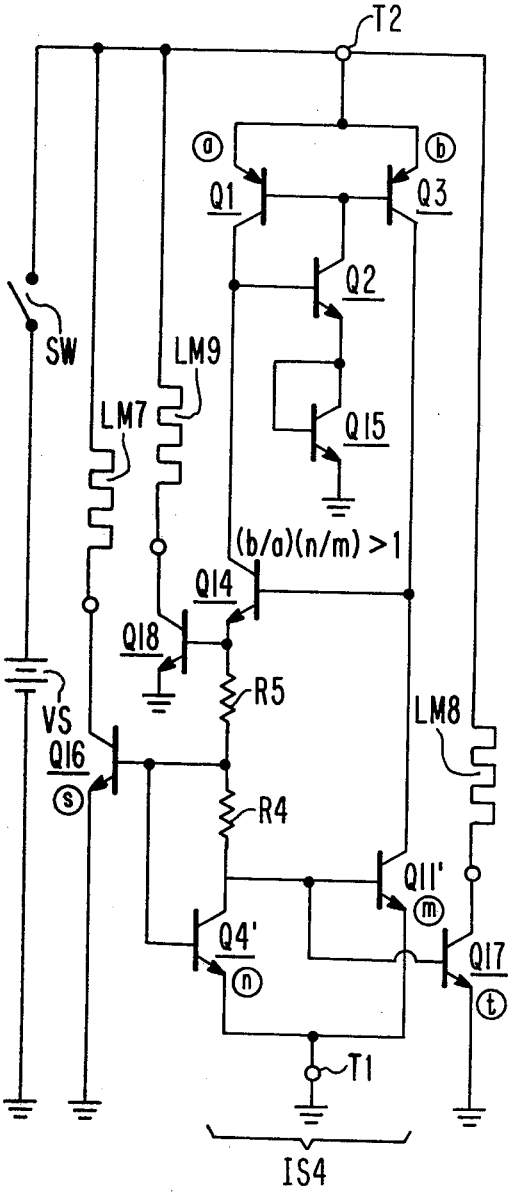

FIG. 6 shows a two-terminal current regulator IS4 differing from regulators IS2 and IS3 with regard to the non-linear amplifier employed in the degenerative feedback loop. IS4 like IS3 uses a common-emitter amplifier transistor Q14 provided non-linear degenerative emitter-to-base current feedback. At low current levels wherethe potential drops across R4 and R5, particularly R4, are negligible, Q4' and Q11' operate as a current mirror amplifier with current gain m/n, reducing the base-to-collector current gain of Q14 by degenerative feedback to substantially n/m. The resultant low gain of the degenerative collector-to-base feedback connection of Q2 permits the increase of current levels in the regenerative feedback loop connection of Q2 with Q1.

The potential drops $V_{R4}$ and $V_{R5}$ across resistors R4 and R5 increases with increased current levels in Q1 and Q2 and thus in Q3, Q14, Q4' and Q11'. The increase in $V_{R4}$ reduces $V_{BEQ11'}$ vis-a-vis $V_{BEQ4'}$ and thus the current gain of the non-linear feedback connection of Q14. Under stabilized operating conditions the effective base-to-collector gain of Q14 will be a/b, requiring $V_{R4}$ to assume a maximum level defined by equation 14.

$$V_{R4\text{-}MAX}=(kT/q)\ ln\ (am/bn) \quad (14)$$

The current flowing substantially as $I_{CQ1'}$ $-I_{CQ14'}$ through R5 and R4, and as $-I_{CQ4'}$ will by Ohm's Law have a value substantially equal to ($kT/q$ $R_4$) ln (am/bn). The current flowing substantially as $I_{CQ3}$ and $-I_{CQ11'}$ will be substantially equal to (b/a) (kT/q $R_4$) ln (am/bn) under stabilized operating conditions. The total current flow between terminals T2 and T1 under stabilized operating conditions will be [1+(b/a)] (kT/q $R_4$ ln (am/bn). The current mirror amplifier relationship between Q4' and Q16 will cause Q16 to draw a collector current equal to (s/n) (kT/q$R_4$) ln (am/bn), if Q16 and load means LM7 are used with regulator IS4. The current mirror relationship between NPN transistors Q11' and Q17, shown as having effective emitter-to-base junction areas in m:t ratio, will cause Q17 to draw a collector current (t/m) (b/a) (kT/q $R_4$) ln (am/bn) through load means LM8, if Q17 and load means LM8 are used with regulator IS4.

FIG. 7 shows a modification that can be made to any of the current regulators IS1, IS2, IS3 or IS4. Q3 does not have applied to it as its emitter-to-base potential $V_{BEQ3}$ the emitter-to-base voltage $V_{BEQ1}$ of Q1 developed in response to current flow through the emitter-to-collector path of Q1. Rather, the current flow to the emitter-to-collector path of Q1 is through the emitter-to-collector path of a PNP transistor Q18 arranged with Q3 in a current mirror amplifier configuration with a current gain b/a. This is an alternative way to scale the collector currents of Q1 and Q3 to be in a:b ratio; and, of course, more complex current mirror configurations than that shown comprising Q18 and Q3 may be similarly used.

A dual-collector PNP transistor QQ may replace PNP transistors Q1 and Q3, as shown in FIG. 8.

In the embodiments of the invention thus far described the non-linear current amplification in the degenerative feedback loop has not involved the scaling of the collector currents of Q1 and Q3 in a:b ratio, but rather has involved non-linear current amplification in Q4 (or Q4') and the elements connected with it to providing inverting amplification of the collector current $I_{CQ3}$ of Q3 prior to $I_{CQ3}$ being applied to the base of Q2. However, the non-linearity in the degenerative feedback loop can instead repose in the interconnections of Q1 and a PNP transistor used as replacement for Q3. Examples of this are the current regulators IS5 and IS6 of FIGS. 9 and 10. In each of these regulators, the collector current of this replacement PNP transistor is applied to the input connection of a current mirror amplifier, comprising PNP transistors Q4 and Q19, to cause a response current (m/u) times as large at its output connection to the base of Q2.

In FIG. 9 Q3 is replaced by PNP transistor Q20 which will exhibit a collector current (b/a) times as large as that of Q1 at the low current levels encountered at start-up, when the potential drop $V_{R6}$ across resistor R6 is negligible. Under stabilized operating conditions, however, $V_{R6}$ reaches the following maximum value.

$$V_{R6\text{-}MAX}=(kT/q)\ ln\ (au/bm) \qquad (15).$$

The current flow through R6 having resistance R6 the emitter-to-collector path of Q1, and the collector-to-emitter path of Q4 is by Ohm's Law substantially equal to (kT/q $R_6$) ln (au/bm); and a current flow substantially u/m times as large flows through the emitter-to-collector path of Q20 and collector-to-emitter path of Q19. The current flow from T1 to T2 is, then, substantially equal to [1+(u/m)] (kT/q $R_6$) ln (au/bm).

In FIG. 10 as the regenerative action of Q1 and Q2 builds up the emitter current of Q1 sufficiently to cause a potential drop $V_{R8}$ across its emitter degeneration resistor R8. At its maximum value $V_{R8\text{-}MAX}$, this drop forward-biases the emitter-base junction of a PNP transistor Q21 to condition it to supply a collector current u/m times as large as that of Q1. The current flowing through R8, Q1 and Q4 will have a value $V_{BEQ21}/R_8$, where $V_{BEQ21}$ is the emitter-base potential offset of Q21; and the current through Q21 and Q19 will have a value u/m times as large. So the current flow between T1 and T2 will have a value [1+(u/m)] ($V_{BEQ21}/R_8$).

In current regulators IS1 of FIGS. 1, 2 and 3; IS2 of FIG. 4, IS3 of FIG. 5 and IS4 of FIG. 6, Q1 and Q3 operate with substantially equal emitter-to-collector voltages improving the capability to keep $I_{CQ1}$ and $I_{CQ3}$ in constant a:b ratio despite change in the voltage afforded by supply VS. Similar advantages may be noted with regard to Q1 and Q20 in IS5 of FIG. 9. The NPN transistors except for Q2 in the regulators IS1, IS2, IS3, IS4, IS5, and IS6 enjoy similar emitter-to-collector potentials to improve tracking of their collector currents.

One skilled in the art and armed with the foregoing disclosure will be able to generate other embodiments of the present invention; and in view of this the scope of the following claims should be liberally construed.

What is claimed is:

1. A regulated current source comprising:

first and second terminals for an operating voltage therebetween;

first and second transistors of complementary conductivity types, each having respective input and output and common electrodes and having a respective principal current conduction path between its common and output electrodes, the conductivity of its principal current conduction path being controlled by the potential appearing between its common and input electrodes;

means connecting said first and second transistors as respective amplifier means in a regenerative feedback loop tending to increase the conduction of their respective principal current conduction paths, including first current conductive means between said first terminal and the common electrode of said first transistor, including second current conductive means between said second terminals and the common electrode of said second transistor, including means direct coupling the output electrode of said first transistor to the input electrode of said second transistor, and including means direct coupling the output electrode of said second transistor to the input electrode of said first transistor;

non-linear amplifier means having an input circuit connected for sensing the level of conduction in the principal current conduction path of said first transistor, having an output circuit connected between the common and input electrodes of said second transistor for completing a degenerative feedback loop, and exhibiting gain between its input and output circuits tending to increase with increasing sensed level of conduction, sufficiently to reduce the open-loop gain of said degenerative feedback loop to unity and thereby stabilize the level of current flowing through the principal current conduction path of said first transistor; and means for supplying an output current proportional to that level of current.

2. A regulated current source as set forth in claim 1 wherein said non-linear amplifier means comprises:

third and fourth transistors of similar conductivity types to those of said first and second transistors, respectively, each of said third and fourth transistors having respective input and output and common electrodes and having a respective principal current conduction path between its common and output electrodes, the conductivity of its principal current conduction path being controlled by the potential appearing between its common and input electrodes;

means applying the potentials at the common and input electrodes of said first transistor to the common electrode and to the input electrode respectively of said third transistor;

resistive means connected between the common and input electrodes of said fourth transistor, the common electrode of said fourth resistor being connected to said second terminal;

a first current conductive path between the output electrode of said third transistor and the input electrode of said fourth transistor; and a second current conductive path between the output electrodes of said fourth and first transistors.

3. A regulated current source as set forth in claim 1 wherein said non-linear amplifier means comprises:

a current mirror amplifier having an input terminal to which the emitter electrode of said first transistor connects, having a common terminal connected to said first terminal, having an input circuit between its input and common terminals which input circuit is included in said first current conductive means, and having an output terminal;

a third transistor of similar conductivity type to that of said second transistor, having an input electrode to which the output terminal of said current mirror amplifier connects, having an output electrode, having a common electrode connected to said second terminal, and having a principal current conduction path between its common and output electrodes, the conductivity of its principal current conduction path being controlled by the potential appearing between its common and input electrodes;

resistive means connected between the common and input electrodes of said third transistor; and a current conductive path between the output electrodes of said third and first transistors.

4. A regulated current source as set forth in claim 1 wherein said first transistor has a second output electrode in addition to its said, first output electrode and wherein said non-linear amplifier means comprises:

a third transistor of similar conductivity type to that of said second transistor, having an input electrode to which the second output electrode of said first transistor connects, having an output electrode, having a common electrode connected to said second terminal, and having a principal current conduction path between its common and output electrodes, the conductivity of its principal current conduction path being controlled by the potential appearing between its common and input electrodes;

resistive means connected between the common and input electrodes of said third transistor; and a current conductive path between the output electrode of said third transistor and the first output electrode of said first transistor.

5. A regulated current source as set forth in claim 2, 3 or 4 wherein said resistive means consists of a substantially linear resistance.

6. A regulated current source as set forth in claim 2, 3 or 4 wherein said resistive means consists of a series connection of a substantially linear resistance and a diode means poled for forward conduction.

7. A regulated current source as set forth in claim 6 wherein said diode means comprises a further transistor having input and output and common electrodes, having a principal current conduction path between its common and output electrodes, the conductivity of its principal current conduction path being controlled by the potential applied between its common and input electrodes, and having its input electrode biased by potential applied from its output electrode.

8. A regulated current source as set forth in claim 1 wherein said non-linear amplifier means comprises:

third and fourth transistors of similar conductivity types to those of said first and second transistors respectively, each of said third and fourth transistors having respective input and output and common electrodes and having a respective principal current conduction path between its common and output electrodes, the conductivity of its principal current conduction path being controlled by the potential appearing between its common and input electrodes;

means applying the potentials at the common and input electrodes of said first transistor to the common electrode and to the input electrode, respectively, of said third transistor;

a first current conductive path between the output electrode of said third transistor and the input electrode of said fourth transistor;

a second current conductive path between the output electrodes of said fourth and first transistors; and a current amplifier having an input connection to the common electrode of said fourth transistor, having an output connection to the input electrode of said fourth transistor, having a common connection to said second terminal, and exhibiting a current gain of $-G$ between its input and output connections, where G is a positive number that decreases as a function of the current received at the input connection of said current amplifier.

9. A regulated current source as set forth in claim 8 wherein said current amplifier comprises:

fifth and sixth transistors of similar conductivity type to said fourth transistor, each having input and output and common electrodes and having a respective principal current conduction path between its common and output electrodes, the conductivity of its principal current conduction path being controlled by the potential appearing between its common and input electrodes;

means connecting the common electrodes of said fifth and sixth transistors together without substantial intervening impedance to said second terminal;

a connection of the input electrode of said fifth transistor to the input connection of said current amplifier;

a resistance having first and second ends connected at the input electrodes of said fifth and sixth transistors, respectively, and having the output electrode of said fifth transistor connected to its second end; and a connection of the output electrode of said sixth transistor to the output connection of said current amplifier.

10. A regulated current source as set forth in claim 1 wherein said non-linear amplifier means comprises:

a current mirror amplifier having an input connection to the emitter electrode of said first transistor, having a common connection to said first terminal, having an input circuit between its output and common connections which input circuit is included in said first current conductive means, and having an output connection;

a third transistor of similar conductivity type to that of said second transistor, having input and output and common electrodes and having a principal current conduction path between its common and output electrodes, the conductivity of its principal conduction path being controlled by the potential appearing between its common and input electrodes;

a first current conductive path between the output connection of said current mirror amplifier and the input electrode of said third transistor;

a second current conductive path between the output electrodes of said third and first transistors; and a current amplifier having an input connection to the common electrode of said third transistor, having an output connection to the input electrode of said third transistor, having a common connection to said second terminal, and exhibiting a current gain of $-G$ between its input and output connections, where G is a positive number that decreases as a function of the current received at the input connection of said current amplifier.

11. A regulated current source as set forth in claim 1 wherein said first transistor has a second output electrode in addition to its said first output electrode and wherein said non-linear amplifier means comprises:

a third transistor of similar conductivity type to that of said second transistor, having an input electrode to which the second output electrode of said first transistor connects, and having an output electrode and a common electrode defining the ends of its principal current conduction path, the conductivity of its principal conduction path being controlled by the potential appearing between its common and input electrodes;

a current conductive path between the output electrode of said third transistor and the first output electrode of said first transistor; and a current amplifier having an input connection to the common electrode of said third transistor, having an output connection to the input electrode of said third transistor, having a common connection to said second terminal, and exhibiting a current gain of $-G$ between its input and output connections, where G is a positive number that decreases as a function of the current received at the input connection of said current amplifier.

12. A regulated current source as set forth in claim 10 or 11 wherein said current amplifier comprises:

fourth and fifth transistors of similar conductivity type to said third transistor, each having input and output and common electrodes and having a respective principal current conduction path between its common and output electrodes, the conductivity of its principal current conduction path being controlled by the potential appearing between its common and input electrodes;

means connecting the common electrodes of said fourth and fifth transistors together without substantial intervening impedance and to said second terminal;

a connection of the input electrode of said fourth transistor to the input connection of said current amplifier;

a resistance having first and second ends connected at the input electrodes of said fourth and fifth transistors, respectively, and having the output electrode of said fourth transistor connected to its second end; and a connection of the output electrode of said fifth transistor to the output connection of said current amplifier.

13. A regulated current source as set forth in claim 9 wherein said second current conductive path is provided between the anode and cathode of diode means poled for forward conduction of current flowing through the common electrode of said second transistor.

14. A regulated current source as set forth in claim 12 wherein said second current conductive path is provided between the anode and cathode of diode means poled for forward conduction of current flowing through the common electrode of said second transistor.

15. A regulated current source as set forth in claim 8, 10 or 11 wherein said current amplifier comprises:

a further transistor of similar conductivity type to that of said second transistor, and further transistor having input and output and common electrodes and having a principal current conduction path between its common and output electrodes, the conductivity of its principal current conduction path being controlled by the potential appearing between its common and input electrodes;

means connecting the input and output electrodes of said further transistor to the input and output connections, respectively, of said current amplifier;

a degeneration resistance connecting the common electrode of said further transistor to said second terminal; and first diode means connected between the input electrode of said further transistor and said second terminal, and poled for forward conduction of current.

16. A regulated current source as set forth in claim 15 wherein said first diode means comprises a still further transistor having input and output and common electrodes, having a principal current conduction path between its common and output electrodes, the conductivity of its principal current conduction path being controlled by the potential applied between its common and input electrodes, and having its input electrode biased by potential applied from its output electrode.

17. A regulated current source as set forth in claim 16 wherein said second current conductive path is provided between the cathode and anode of second diode means poled for forward conduction of current flowing through the common electrode of said second transistor.

18. A regulated current source as set forth in claim 1 wherein resistive means is included in said first current conductive means and wherein said non-linear amplifier means comprises:

a third transistor of a similar conductivity type to that of said first transistor, having an input electrode to which the potential at the input electrode of said first transistor is applied, having an output electrode, having a common electrode connected to said first terminal, and having a principal current conduction path between its common and output electrodes, the conductivity of its principal conduction path being controlled by the potential appearing between its common and input electrodes;

a current mirror amplifier having an input connection to the output electrode of said third transistor, having an output connection, and having a common connection to said second terminal; and a current conductive path between the output connection of said current mirror amplifier and the output electrode of said first transistor.

19. A regulated current source as set forth in claim 1 wherein resistive means is included in said first current conductive means and wherein said non-linear amplifier means comprises:

a third transistor of a similar conductivity type to that of said first transistor, having an input electrode to which the potential at the common electrode of said first transistor is applied, having an output electrode, having a common electrode connected to said first terminal, and having a principal current conduction path between its common and output electrodes, the conductivity of its principal conduction path being controlled by the potential appearing between its common and input electrodes;

a current mirror amplifier having an input connection to the output electrode of said third transistor, having an output connection, and having a common connection to said second terminal; and a current conductive path between the output connection of said current mirror amplifier and the output electrode of said first transistor.

* * * * *